US006418869B1

(12) United States Patent
Miller

(10) Patent No.: US 6,418,869 B1
(45) Date of Patent: Jul. 16, 2002

(54) BARGE MOUNTED FOOD GRADE CONTAINER SYSTEM

(76) Inventor: Felton Michael Miller, 10591 Thomas Rd., Tuscaloosa, AL (US) 35405

( * ) Notice: Subject to any disclaimer, the term of this patent is extended or adjusted under 35 U.S.C. 154(b) by 0 days.

(21) Appl. No.: 09/837,432

(22) Filed: Apr. 19, 2001

(51) Int. Cl.[7] ..... B63B 35/28
(52) U.S. Cl. ..... 114/26; 114/73; 220/1.5
(58) Field of Search ..... 114/26, 72, 73, 114/74 R; 220/1.5, 668

(56) References Cited

U.S. PATENT DOCUMENTS 2,513,004 A * 6/1950 Cooley ..... 114/72
3,003,452 A * 10/1961 Sangerlaub ..... 114/72
4,648,521 A * 3/1987 Thomas et al. ..... 220/1.5
5,996,827 A * 12/1999 Splane ..... 220/1.5
6,003,705 A * 12/1999 Burguieres, Jr. ..... 220/1.5
6,142,327 A * 11/2000 Riggio et al. ..... 206/596

* cited by examiner

*Primary Examiner*—Sherman Basinger
(74) *Attorney, Agent, or Firm*—Jacobson Holman, PLLC

(57) ABSTRACT

A container assembly comprising a square frame as viewed in plan formed of four vertical corner frame components and a plurality of horizontal frame components with a generally cylindrical dry bulk receiving container mounted within the square frame with the dimensions of the square frame being such that longitudinal and transverse rows of the container assemblies can be snugly, but removably, received within the cargo carrying space of conventional barges.

20 Claims, 5 Drawing Sheets

BARGE MOUNTED FOOD GRADE CONTAINER SYSTEM

BACKGROUND OF THE INVENTION

The present invention is directed to the field of dry bulk shipping and is more specifically directed to an apparatus and method of barge shipping food, grain or other products requiring avoidance of contamination. Another aspect of the invention resides in the provision of plural barge-mounted containers for food grade products in conjunction with pneumatic loading and discharge means that is selectively operable for loading and unloading selected individual containers or all of the containers as required.

The currently available bulk shipping containers are designed and dimensioned so as to be stacked horizontally in or on a barge or ocean going vessel. Such conventional containers are commonly provided with a length of 20 ft. or 40 ft. so as to comply with the dimension requirements for container carrying ocean going vessels. Such containers are designed to be moved from one mode of transportation to another such as from a rail car or truck to an ocean going container ship or vice versa. The size of such conventional containers is such that they are not readily usable for barge transport. Hopper cars are frequently used for the transport of food grade bulk products by rail and trucks are also available for that purpose. However, it is not possible to use barges for transport of food grade bulk products due to the incompatibility of presently known containers with the dimensional requirements of barges. Consequently, the public is deprived of the substantial savings that are possible from the use of barge transportation of food grade bulk products. Thus, a significant aspect of the present invention is the provision of containers which can be used on barges in an efficient and economical manner and in compliance with the U.S. Food and Drug regulations including Regulation 117-1520.

Additionally, many products such as powdered alumina, talc and the like powders cannot be transported by barge, rail or truck due to the creation of excessive dust when such products are loaded and unloaded by the common means of conveying or dumping. Moreover, food grade materials as well as many other materials cannot be moved by barge due to the likelihood of contamination from loading, unloading or storage in the cargo hold of a barge. Thus, there is a wide range of products that have not previously been moved by barge due to the likelihood of contamination. While there are containers on the market which can protect food grade and other sensitive materials, such containers do not readily fit in a conventional cargo hold of a barge which is normally approximately 28 ft. wide by 185 ft. to 188 ft. long. The foregoing practice results in it being impossible to ship food grade and other sensitive products domestically by the cleanest, safest and most efficient way.

None of the known prior art addresses the problems to which the subject invention is directed. More specifically, By U.S. Pat. No. 4,072,120 discloses a complicated arrangement of multiple containers removably mounted on various types of seagoing powered vessels. Klundt et al. U.S. Pat. No. 5,359,952 discloses a barge provided with means for carrying stacked containers. The barge is configured to carry maximum load of containers and still fit within a standard lock. The height of the barge and cargo is said to be 45 feet. Nemec et al. U.S. Pat. No. 3,919,959 discloses a system of barges that are intended to be carried on a mother ship and later moved to their destinations as smaller units consisting of a few containers. Nemec et al. U.S. Pat. No. 3,830,177 is similar to Nemec et al. U.S. Pat. No. 3,919,959 in disclosing stacked containers on a vessel. Cushing et al. U.S. Pat. No. 3,823,681 discloses a ship designed to carry a plurality of barges which are preloaded with containers. Fletcher U.S. Pat. No. 3,550,550 discloses an ocean-going barge provided with a plurality of vertically stacked removable containers. Lewis et al. U.S. Pat. No. 3,820,664 discloses a barge and cargo handling system for moving factory constructed housing units by barge and ship from the point of manufacture. Oshima U.S. Pat. No. 3,467,044 discloses a barge employing internal guide-frame members for stacking containers and including means for positioning non-containerized freight beneath the stacked containers. Toth et al. U.S. Pat. No. 5,647,514 discloses an elongated non-cylindrical horizontally extending bulk container made of stainless steel, aluminum or other materials of sufficient strength and fixedly and permanently attached to a vessel. Kee U.S. Pat. No. 5,960,974 discloses an elongated aluminum container extending horizontally in a frame welded to a large vessel.

Therefore, it is the primary object of the present invention to provide a new and improved apparatus for shipping food grade and other pollution sensitive or causative materials in an efficient, safe and cost-effective manner.

Yet another object of the present invention is provision of new and improved apparatus for shipping food grade and other sensitive materials by barge in a cost-effective, safe and reliable manner.

A further object of the present invention is to provide a new and improved dry bulk product transport container that is useful in transfer of powdered materials from barges to alternative modes of transportation.

A further object of the present invention is the provision of a dry bulk product transport container that is economical to construct and use and uses generally available conventional methods for loading and unloading the product including pressurized pneumatic, negative pneumatic and gravity actuated procedures.

SUMMARY OF THE INVENTION

Achievement of the foregoing objects is enabled by the preferred embodiment of the invention which consists of a container assembly which includes a dry bulk product sealable container constructed of medium or high density polyethylene that complies with U.S. Food and Drug Administration Regulation 117.1520 and which is of vertically extending cylindrical configuration having a lower extent defined by a conical floor terminating at its apex with a discharge valve. The cylindrical container is mounted in a vertically extending steel frame comprising four vertical frame components each defining a corner of the assembly and which are interconnected by horizontal frame components all of equal length to create a rigid and reliable support for the cylindrical container which is positioned within the confines of the steel framework. The upper end of the container includes a removable man-hole cover, a five-inch fill line or pipe and a five-inch vent.

Each container assembly is dimensioned so that the containers can be provided in three longitudinal rows each extending longitudinally of a barge with each row substantially filling the length direction and dimension of the barge which is normally in the range of 185 ft. to 188 ft. Similarly, the containers are also arranged in transverse rows consisting of a container from each of three longitudinal rows extending across the width of the barge and substantially filling the 28 ft. width of the barge so that the container assemblies efficiently fill the cargo volume space of the barge while maintaining their contents in a pure condition from external pollution. However, the containers can be easily either filled or emptied using conventional dockside equipment for discharge into truck or rail transportation means for further transport or alternatively for discharge directly into raw material receiving means of a manufacturing plant or the like.

DETAILED DESCRIPTION OF THE INVENTION

Figure 1:
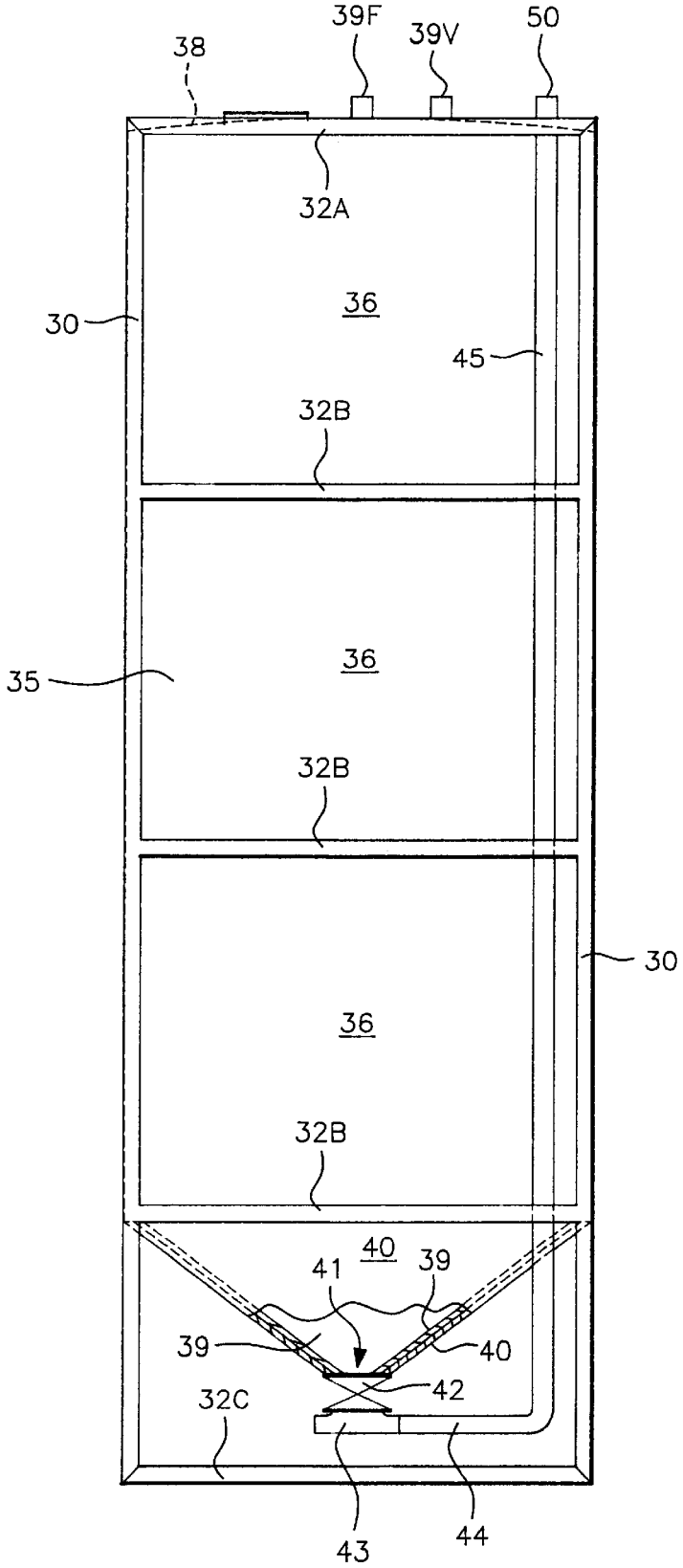
FIG. 1 is a front elevation view of the preferred embodiment of the container assembly invention with a portion of an external conical steel container support cone being removed to illustrate a portion of the conical lower end of the product container supported by the steel container support.
Figure 4:
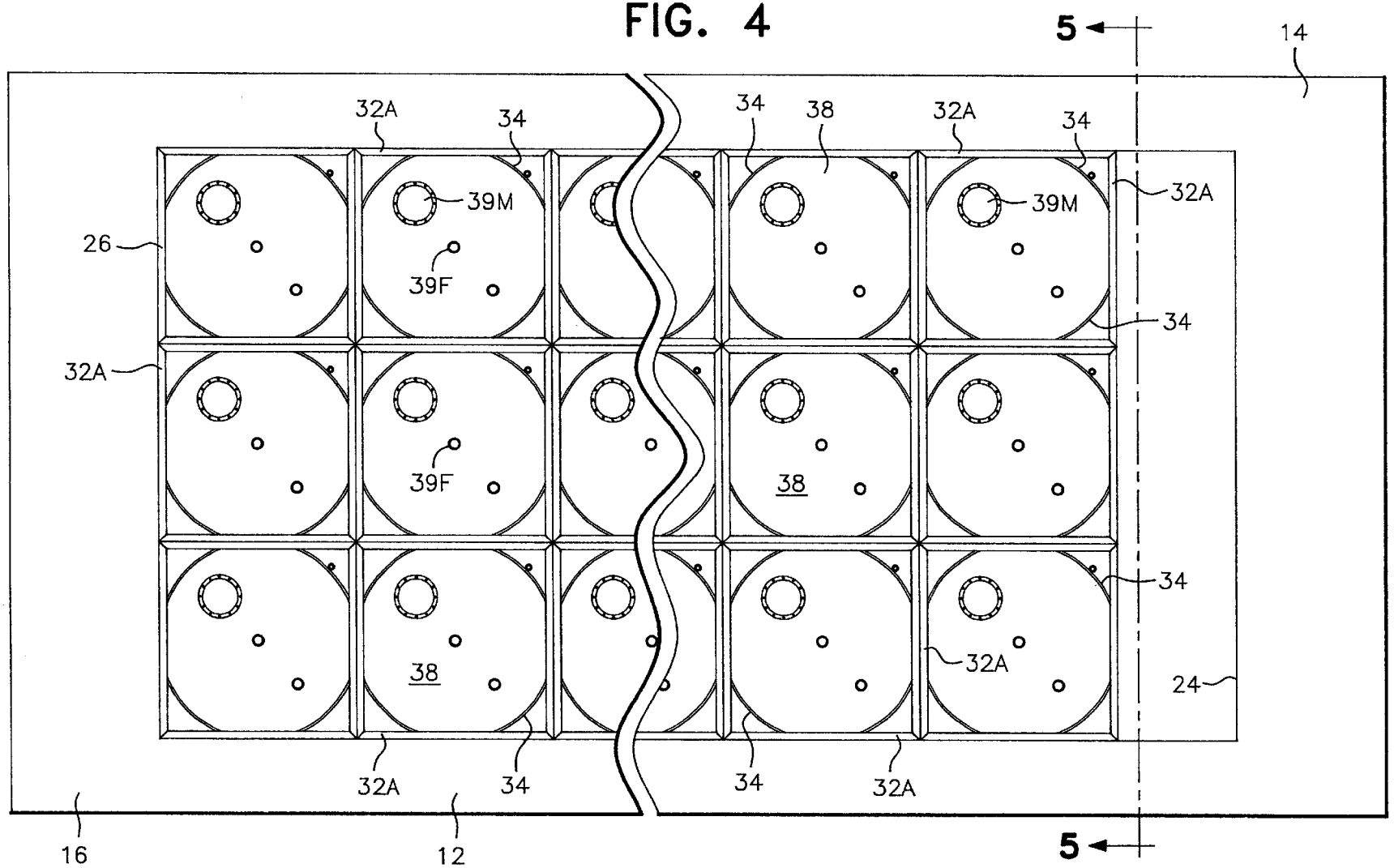
FIG. 4 is a top plan view illustrating the positioning of a plurality of the individual container assemblies filling the cargo space of a barge.
Figure 5:
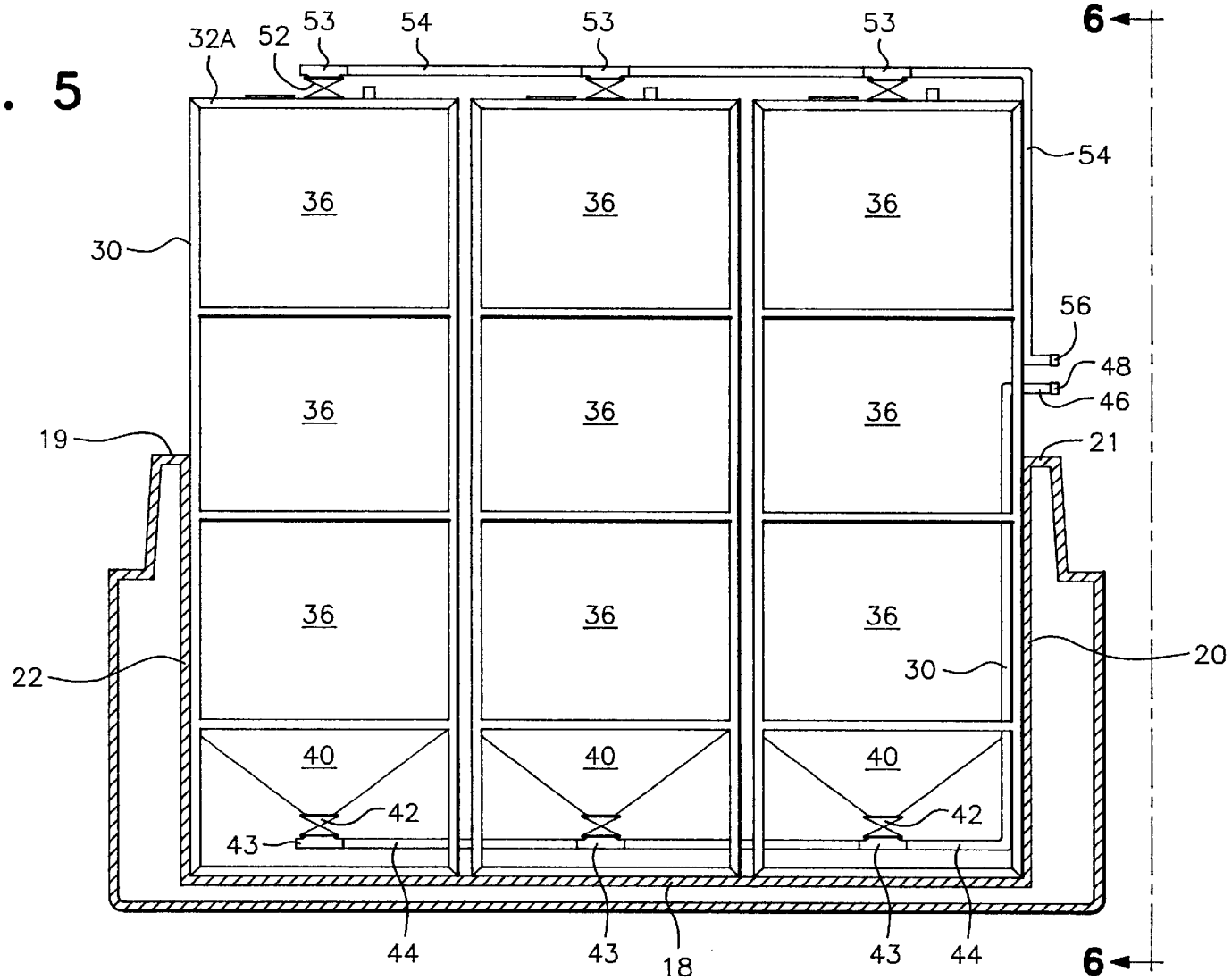
FIG. 5 is a sectional view taken along lines 5—5 of FIG. 4.
Figure 6:
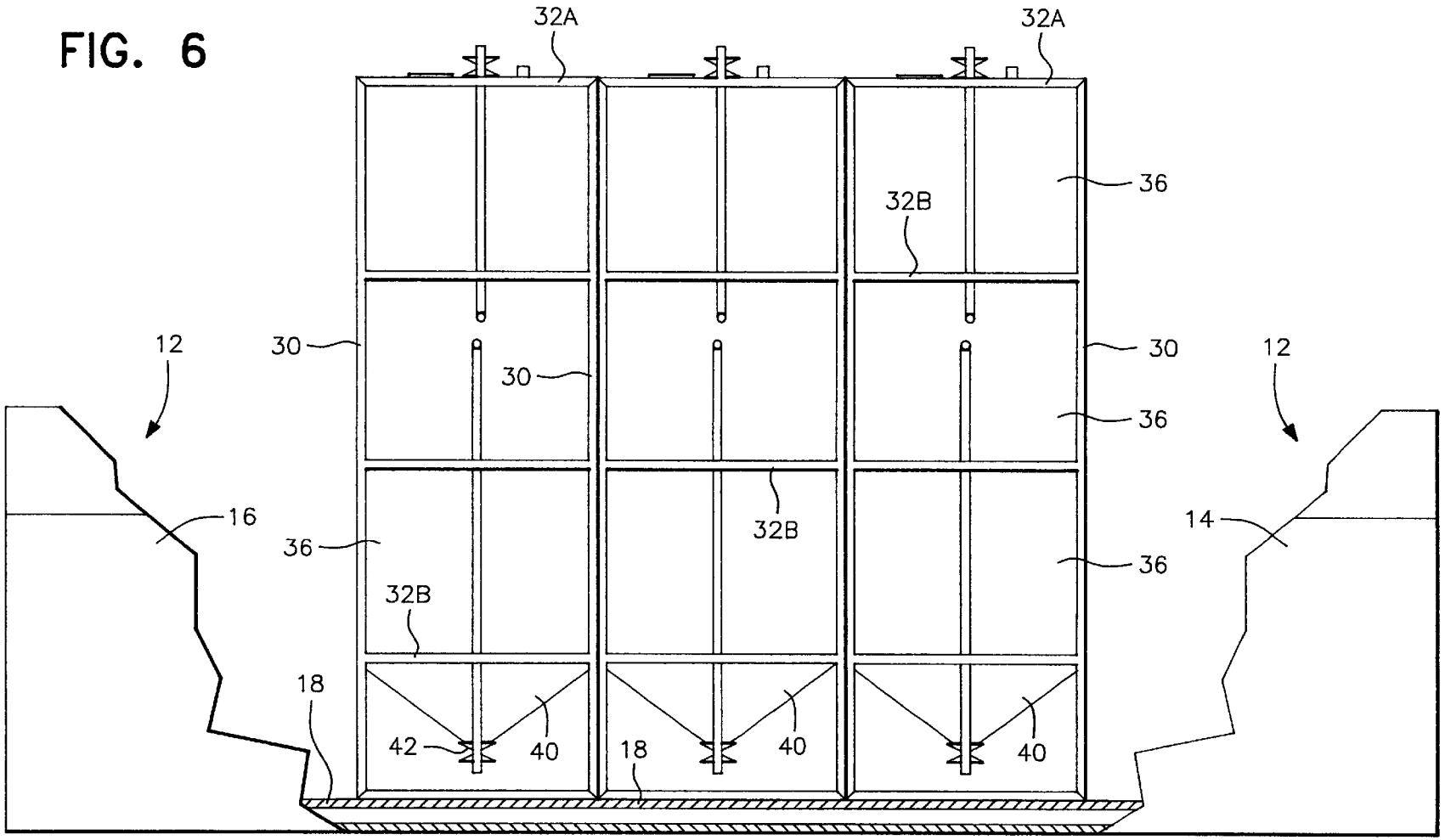
FIG. 6 is a sectional view taken along lines 6—6 of FIG. 5 in which a portion of the barge is broken away for clarity.

Attention is initially invited to FIG. 1 of the drawings which illustrates a single container assembly, generally designated 10, which is designed and dimensioned to be used with other identical container assemblies of the same type for transport by a barge 12 having a bow or forward end 14 and a stem 16 as shown in FIG. 4. Barge 12 also has an inner hull which is defined by a lower floor or deck 18 of rectangular configuration, a left side wall 20 and a right side wall 22 with barge side decks 19 and 21 defining the upper extent of the barge on each side as shown in FIG. 5. Left side wall 20 and right side wall 22 are both of rectangular configuration and the forward end of the cargo receiving space is defined by a forward wall 24 of rectangular configuration with the rear end of the cargo receiving area being defined by a rear wall 26 as shown in FIG. 4. The distance between left side wall 20 and right side wall 22 is approximately 28 ft. and the distance between the forward wall 24 and the rear wall 26 is in the range of 185 ft. to 188 ft.

Each container assembly 10 includes an external steel frame consisting of four angle member vertical steel corner frame components 30. The vertical steel corner frame components 30 are identical and each is formed of conventional angle configuration consisting of two plates each of which is ¼" thick and four (4) inches wide. The corner frame components are connected by horizontal square frame components comprising upper horizontal square frame formed of four conventional channel configuration linear frame components 32A, three interior square frames each formed of four linear frame components 32B and a lower horizontal square frame formed of four linear frame components 32C. Each of the horizontal frame components 32A, 32B and 32C is of conventional channel (U-shaped) configuration formed of three ¼" thick steel plates that are three (3) inches wide and are nine (9) feet long. Therefore, each level of the horizontal frame components defines a square having sides that are 9 ft. long. All of the horizontal frame components are of U-shaped configuration consisting of a 3" base plate positioned in a vertical plane and two parallel side plates positioned in horizontal planes. However, it should be understood that another sectional construction such as square tubing construction could also be employed if desired. It should also be noted that arcuate bridge brace plates 34 are provided inwardly of each corner of the upper horizontal frame formed of upper horizontal frame components 32A to which brace plates 34 are welded and identical arcuate bridge plates (not shown) are similarly provided in each of the three horizontal frames of interior frame components 32B.

Figure 2:
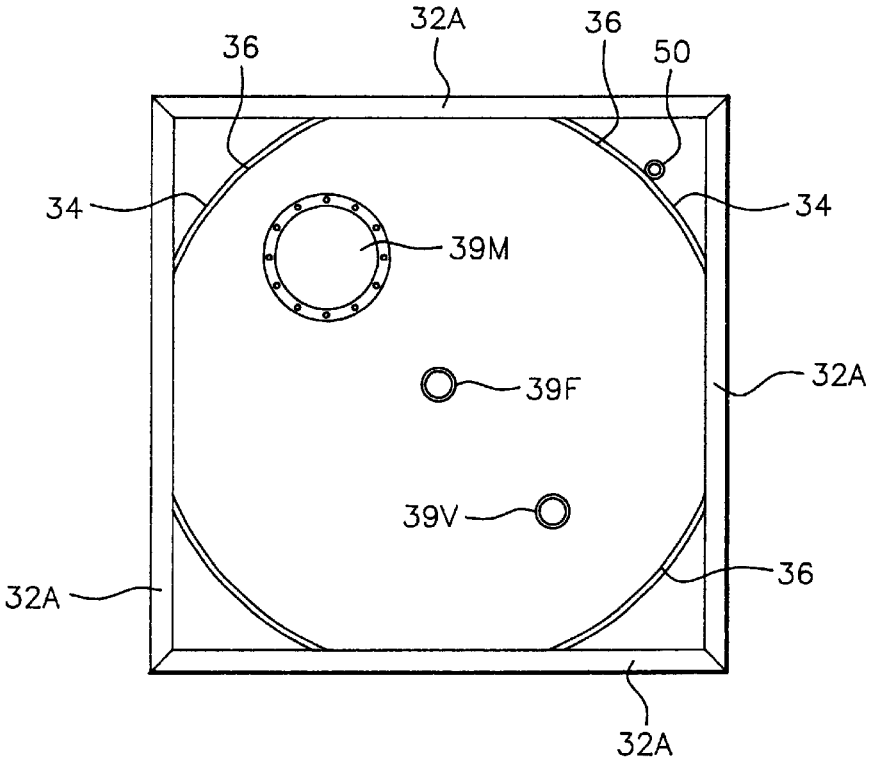
FIG. 2 is a top plan view of the preferred embodiment container assembly of FIG. 1.
Figure 3:
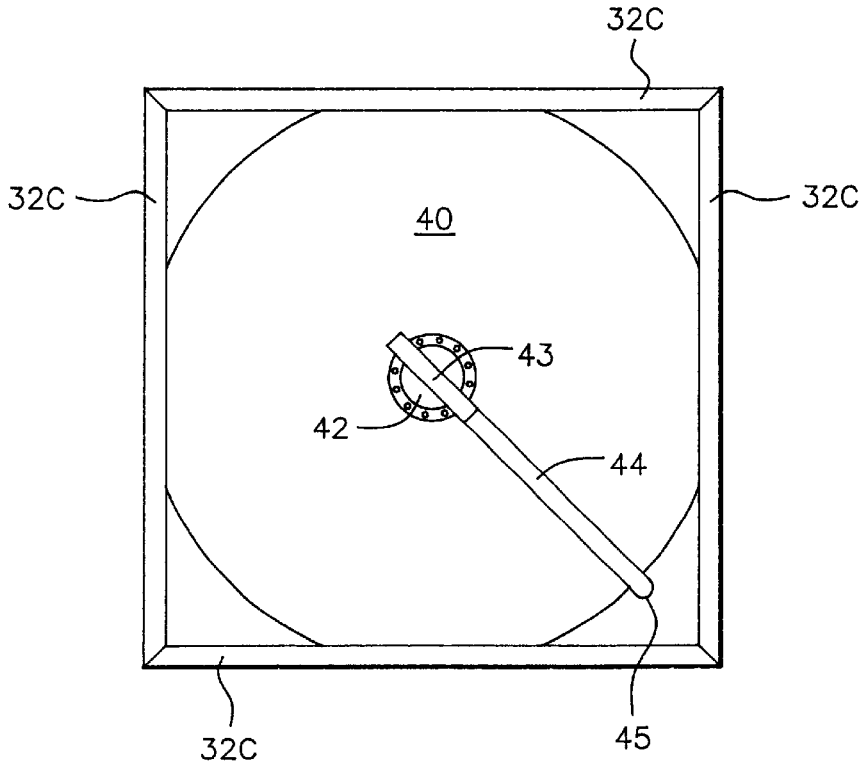
FIG. 3 is a bottom plan view of the preferred embodiment container assembly of FIG. 1.

A steel container support cone 40 (FIG. 1) has a valve receiving opening 41 in its lower end in which a five inch discharge valve 42 is positioned. Cone 40 is fixedly attached to and supported by the lower end of the frame immediately adjacent the lowest interior frame members 32B. Valve 42 communicates with the lower end of a conical lower end component 39 of a fully sealable-dry bulk product container 35. Conical lower end component 39 is matingly received in the steel container support cone 40 which supports container 35. It should be noted that container 35 is preferably formed of medium or high density polyethylene that complies with the U.S. Food and Drug Regulation 117.1520. It should also be understood that container 35 can be made of suitable metal if desired. Container 35 also includes a cylindrical wall component 36 extending upwardly from conical lower end component 39 and a slightly domed top component 38. The cylindrical wall component 36 is preferably provided with inwardly extending tangential grooves, not shown, each dimensioned to receive one of the internal horizontal frame components 32B. However, an alternative construction would be to reduce the diameter of wall 36 from that shown in FIGS. 2 and 3 so as to completely fit within the confines of the square frames formed of frame components 32A and 32B. Yet another option would be to configure wall 36 to consist of alternating flat surfaces and curved surfaces as viewed from above and which would be identical to FIG. 2 in appearance.

The normal mode of assembly of the frame and container 35 would be to assemble three sides of the frame while leaving one side open to permit positioning of the container 35 in the interior of the partially assembled frame component following which positioning the remaining horizontal side frame members 32A and 32B would be welded into position to complete the fourth side of the frame assembly with the container positioned therein.

The five-inch discharge valve 42 is fitted in opening 41 in the lower end of steel cone 40 and is connected at its upper end to the interior of the lower end of conical lower end component 39 of product container 35 for receiving product therefrom. Discharge valve 42 is connected at its lower end by a low profile cast aluminum five-inch tee 43 to a four-inch product discharge line 44. Valve 42 is preferably a five-inch Sure Seal® No. 5-890-255-701 SH10 aluminum butterfly valve having a two piece aluminum body and a ten position handle with extension to control the product flow discharge rate while unloading product from container 35. Discharge line 44 is connected at its downstream end to a vertical top discharge component line 45 which extends upwardly inside the framework as shown in FIG. 1 to terminate above the upper dome top wall component 38 at a male cam lock coupling 50 on its upper end for permitting connection to a product receiving dockside vacuum line (not shown).

It should also be noted that tee 43 can be connected either to a single discharge line 44 as shown in FIG. 1 or connected in series with similar tee members on each transversely aligned row of three container assemblies 10 in the manner shown in FIG. 5. When the tee 43 is connected to only a single output line, the other end of the tee is closed by a cap or other conventional means in order to preclude unintended discharge of the material from the container assembly 10.

When the containers are arranged for simultaneous discharge in the manner illustrated in FIG. 5, the product discharge line 44 has a reduced height vertical component line 45 terminating at an upper horizontal line 46 which extends outwardly to a location above the barge side deck 21 as shown or alternatively above side deck 19. A Sure Seal® male connector 48 is provided on the outer end of upper horizontal line 46. Male connector 48 easily permits connection to the particular dockside pneumatic material handling system which would receive and convey the powdered bulk material and deliver it to either truck loading or rail freight loading means in most instances. However, it would also be possible to deliver the powdered bulk material to processing means when the barge is docked at an industrial facility.

The four-inch vertical discharge line 45 is aligned with either one of the two corner spaces inside the framework assembly facing the side of the barge. The upper end of the vertical component 45 of the discharge line 44 is also provided with a quick-connect Sure Seal® or other conventional male coupling (not shown).

The dome top wall component 38 includes a five-inch fill line 39F connected to supply valve means 52 which is connected to tee means 53 which is in turn connected to a product supply line 54 as shown in FIG. 5. Vent line 39V is provided with a standard valve and/or male cam lock coupling so that it can be connected to a bag house or filter instillation to control dust when product is being blown into the container. Similarly, the product supply line 54 is provided with a standard male cam lock coupling to allow the container interior to be connected to a trailer, rail car or other device for effecting filling of the container with product.

Dome top wall component 38 is also provided with a manhole 39M to permit access to the interior of the container for cleaning, repair and/or inspection. It should be noted that fill line 39F, vacuum line 39V and manhole 39M can be located at practically any part of domed top wall component 38. Alternatively, individual fill lines for each container could be used to avoid cross-contamination of the containers when shipping up to sixty (60) different grades, colors, compounds or the like.

An additional advantage of the present invention is that the width of the barge cargo compartment is 28 ft. whereas a transverse line of three containers each being 9 ft. in width and length as shown in FIG. 5 is only 27 ft. and the length of the front to rear lines consisting of 20 containers is 180 ft. whereas the barge space for receiving them is in the range of 185 ft. to 188 ft. so that there is sufficient clearance space between adjacent container assemblies to permit them to be easily positioned on or removed from the barge by crane or other similar equipment. The height of the containers is 25 ft. so that the height is less than the pilot house of a conventional tow boat and the containers do not present a hazard of collision with overhead bridges and the like.

Thus, the preferred embodiment of the invention enables a quick and efficient loading or unloading of individual container assemblies or pluralities of container assemblies containing the same product. Moreover, the use of plural containers of relatively small capacity permits a loading or unloading function to continue with only slightly diminished capacity in the event of malfunction as compared to large container unloading or loading procedures in which a malfunction can completely shut down the operation.

It should be understood that the invention is not limited to the embodiments as disclosed herein and should be limited only by the appended claims. Numerous modifications of the invention will undoubtedly occur to those of skill in the art; for example, the container can be formed of materials other than polyethylene such as stainless steel, aluminum, fiber or composite materials, or any other material that is of sufficient strength. Similarly, various conventional connectors can be employed for connecting the discharge line and the fill line to dockside handling systems. Therefore the spirit and scope of the invention is defined solely by the following claims.

What is claimed is:

1. A dry powder-like product handling container assembly for use with other identical containers on a barge, said container assembly comprising an external steel frame of square configuration as viewed from above and rectangular configuration as viewed from the front, rear and side; a generally cylindrical vertically oriented container for holding said dry product positioned in and supported by said external steel frame and including a cylindrical wall having a vertical axis, a lower end portion and a product discharge valve in said lower end portion and wherein said square configuration side dimension is slightly less than one-third the width of a cargo space of a barge with which said container is to be used for transport of said product.

2. A dry product handling container assembly as recited in claim 1, wherein said square configuration side dimension is slightly less than one twentieth the length of said cargo space of the barge with which said container is to be used.

3. A container assembly as recited in claim 2, wherein said cylindrical container is formed of plastic material and includes a top wall component in which a fill line and a vent line are provided.

4. A product handling container assembly as recited in claim 3 additionally including a product discharge line connected to tee means attached at one end to said product discharge valve and extending to a discharge end positioned externally of said steel frame for permitting connection to a dockside product handling and receiving means.

5. A product handling container assembly as recited in claim 1 additionally including a domed top component at the upper end of said cylindrical wall, a fill line, a vent line and a manhole provided in said dome top component to communicate with the interior generally cylindrical vertically oriented cylindrical container.

6. A dry product handling container assembly as recited in claim 5, wherein said square configuration side dimension is slightly less than one twentieth the length of said cargo space of the barge with which said container is to be used.

7. A product handling container assembly as recited in claim 5 additionally including a product discharge line connected to tee means attached at one end to said product discharge valve and extending to a discharge end positioned externally of said steel frame for permitting connection to a dockside product handling and receiving means.

8. A container assembly as recited in claim 1, wherein said external steel frame includes four vertical steel corner frame components, four upper horizontal frame components, four lower horizontal frame components and twelve interior horizontal frame components and wherein said horizontal frame components are perpendicular and connected to said vertical steel corner frame components.

9. A dry product handling container assembly as recited in claim 8, wherein said square configuration side dimension is slightly less than one twentieth the length of said cargo space of the barge with which said container is to be used.

10. A container assembly as recited in claim 9, wherein said cylindrical container is formed of plastic material and includes a top wall component in which a fill line and a vent line are provided.

11. A product handling container assembly as recited in claim 10 additionally including a product discharge line connected to tee means attached at one end to said product discharge valve and extending to a discharge end positioned externally of said steel frame for permitting connection to a dockside product handling and receiving means.

12. A product handling container assembly as recited in claim 8 additionally including a domed top component at the upper end of said cylindrical wall, a fill line, a vent line and a manhole communications through said dome top component with the interior of the generally cylindrical vertically oriented cylindrical container.

13. A product handling container assembly as recited in claim 1, wherein said external steel frame includes an open-topped conical container support cone and said container lower end portion comprises an inverted conical lower end component matingly received in said container support cone so that said container is supported by said container support cone.

14. A dry product handling container assembly as recited in claim 13, wherein said square configuration side dimension is slightly less than one twentieth the length of said cargo space of the barge with which said container is to be used.

15. Means for transporting dry power-like material comprising barge means having a cargo receiving compartment provided between two sidewalls with a width distance apart, a rear wall and a forward wall spaced a length distance apart and a floor, a plurality of container assemblies arranged in transverse rows and lengthwise extending rows relative to said cargo receiving compartment, each of said container assemblies comprising an external steel frame of square configuration as viewed from above and rectangular configuration as viewed from the front, rear and side; a generally cylindrical container positioned in and supported by said external steel frame and including a lower end portion and a product discharge valve in said lower end portion and wherein said square configuration side dimension is such that the sum of the widths of said container assemblies in each of said transverse rows is sufficiently less than said width distance to enable vertical movement of a single container assembly into and out of one of said transverse rows of which said container assembly is a part while the said transverse row is being otherwise completely filled with container assemblies.

16. The means as recited in claim 15, wherein said square configuration side dimension is slightly less than one twentieth the length of said cargo space of the barge with which said container is to be used.

17. The means as recited in claim 16, wherein said cylindrical container is formed of plastic material and includes a top wall compartment in which a fill line and a vent line are provided.

18. The means as recited in claim 17 additionally including a product discharge line connected to tee means attached at one end to said product discharge valve and extending to a discharge end positioned externally of said steel frame for permitting connection to a dockside product handling and receiving means.

19. The means as recited in claim 15, wherein said square configuration side dimension of each of said container assemblies is such that the sum of said side dimensions of the container assemblies is one of said fully filled lengthwise extending rows is sufficiently less than the length distance between said rear wall and said forward wall of said barge to permit vertical movement of any one of the container assemblies in that row relative to the other container assemblies.

20. The means as recited in claim 19, wherein said square configuration side dimension is slightly less than one twentieth the length of said cargo space of the barge with which said container is to be used.

* * * * *